US009546511B2

(12) United States Patent
Dittmer

(10) Patent No.: US 9,546,511 B2
(45) Date of Patent: Jan. 17, 2017

(54) ADJUSTABLE OVERHEAD DOOR HINGE

(71) Applicant: Jay S. Dittmer, Prior Lake, MN (US)

(72) Inventor: Jay S. Dittmer, Prior Lake, MN (US)

(73) Assignee: Jay S. Dittmer, Prior Lake, MN (US)

( * ) Notice: Subject to any disclaimer, the term of this patent is extended or adjusted under 35 U.S.C. 154(b) by 0 days.

(21) Appl. No.: 14/493,286

(22) Filed: Sep. 22, 2014

(65) Prior Publication Data

US 2015/0101763 A1 Apr. 16, 2015

Related U.S. Application Data

(60) Provisional application No. 61/880,879, filed on Sep. 21, 2013.

(51) Int. Cl.
*E05D 15/00* (2006.01)
*E05D 15/24* (2006.01)
*E05D 15/16* (2006.01)

(52) U.S. Cl.
CPC ..... *E05D 15/242* (2013.01); *E05D 15/165* (2013.01); *Y10T 16/536075* (2015.01)

(58) Field of Classification Search
CPC ..... E05D 15/165; E05D 15/18; E05D 15/24; E05D 15/242; E05D 2015/225; E05D 15/244; E05D 15/246; E05D 15/248
USPC ..... 160/201, 229.1
See application file for complete search history.

(56) References Cited

U.S. PATENT DOCUMENTS 1,985,976 A * 1/1935 Clark ..... E05D 15/165 16/104
2,239,273 A * 4/1941 Rowe ..... E05D 15/165 16/94 R
2,525,309 A * 10/1950 Norberg ..... E05D 15/165 16/104
2,703,141 A * 3/1955 McKee ..... E05D 15/165 16/104
2,877,843 A * 3/1959 Stroup ..... E05D 15/165 16/98
3,008,175 A * 11/1961 Biedinger ..... B21D 53/40 16/386
3,376,913 A * 4/1968 Clapsaddle ..... E05D 15/165 16/223
3,709,554 A * 1/1973 Feher ..... A47C 4/26 297/26

(Continued)

FOREIGN PATENT DOCUMENTS

SE WO 8801006 A1 * 2/1988 ..... E05D 15/165

*Primary Examiner* — Katherine Mitchell
*Assistant Examiner* — Johnnie A Shablack
(74) *Attorney, Agent, or Firm* — Patterson Thuente Pedersen, P.A.

(57) ABSTRACT

A hinge for a multi-panel door includes a first bracket, a second bracket pivotally coupled to the first bracket, and a carrier link carrying a roller adapted to engage in a door track. The first bracket is adapted to be operably attached to a first panel of the multi-panel door, the second bracket is adapted to be operably attached to second panel of the multi-panel door, and the carrier link is pivotally attached to one of the first bracket or the second bracket. The carrier link is selectively positionable in a plurality of pre-defined positions, such that at each of the pre-defined positions, the roller is disposed at a different position relative to the first bracket and the second bracket so that the roller can be spaced apart a variety of different distances from the door.

6 Claims, 11 Drawing Sheets

(56) References Cited

U.S. PATENT DOCUMENTS 4,115,900 A * 9/1978 Mihalcheon ..... E05D 15/165 16/104
5,235,724 A * 8/1993 Perrin ..... E05D 15/165 16/223
5,884,363 A * 3/1999 Tofts ..... E05D 15/242 16/104
6,015,003 A * 1/2000 Switzgable ..... E05D 1/04 16/355
6,098,697 A * 8/2000 Krupke ..... E05D 15/165 160/229.1
6,112,799 A * 9/2000 Mullet ..... E05B 65/0021 160/201
7,201,207 B2 * 4/2007 Colston ..... E05D 15/242 160/201
7,454,815 B2 * 11/2008 Brinkmann ..... E05D 15/24 16/271
7,549,456 B2 * 6/2009 Preising, Jr. ..... E05D 15/165 16/91
7,784,520 B2 * 8/2010 Paulson ..... E05D 15/24 16/91
8,091,607 B2 * 1/2012 Aquilina ..... E05D 15/165 160/201
8,555,949 B2 * 10/2013 Mortier ..... E05D 15/242 16/97
8,813,309 B2 * 8/2014 Friesen ..... E05D 15/242 16/91
9,115,523 B2 * 8/2015 Friesen ..... E05D 15/242
9,212,511 B2 * 12/2015 Mortier ..... E05D 15/242
2004/0007334 A1 * 1/2004 Lewis, Jr. ..... E05D 15/242 160/201
2004/0163776 A1 * 8/2004 Brown ..... E06B 3/485 160/229.1
2005/0155725 A1 * 7/2005 Verheye ..... E05D 11/0054 160/229.1
2005/0251958 A1 * 11/2005 Coblentz ..... E05D 15/24 16/97
2005/0273976 A1 * 12/2005 Sarver ..... E05D 15/242 16/242
2006/0080806 A1 * 4/2006 Johnson ..... E05D 15/165 16/387
2013/0248126 A1 * 9/2013 Roberts ..... B60J 5/14 160/201
2015/0101763 A1 * 4/2015 Dittmer ..... E05D 15/165 160/202

* cited by examiner

--PRIOR ART--

--PRIOR ART--

ADJUSTABLE OVERHEAD DOOR HINGE

RELATED APPLICATIONS

This application claims the benefit of U.S. Provisional Application No. 61/880,879, entitled ADJUSTABLE OVERHEAD DOOR HINGE, filed Sep. 21, 2013, said application hereby fully incorporated herein by reference.

FIELD OF THE INVENTION

The invention relates generally to hinges for overhead doors, and more specifically to an adjustable hinge for an overhead garage door.

BACKGROUND OF THE INVENTION

An overhead garage door 8 as depicted in FIG. 1 usually includes several horizontally oriented sections 10, 12, 14, 16 hinged together, and with rollers 18 at each edge that ride in tracks 20 such that the door 8 rolls up and down vertically when opened and closed. The tracks 20, in which the door 8 rides, angle slightly away from door frame 22 bottom-to-top in order to facilitate opening of door 8 without rubbing or binding on frame 22 as the door opens.

It is desirable that all the door sections 10, 12, 14, 16 are as close as possible to door frame 22 when door 8 is in the closed position in order to facilitate sealing of the opening defined by frame 22 against weather and against the passage of unwanted insects and pest animals. As a result, the hinges between the successive vertical door sections 10, 12, 14, 16 have slightly different geometry, and are actually numbered for uniformity in the industry as depicted in FIG. 1A. Starting at the bottom of the door, hinges 24 between the first and second door sections are assigned location #1, hinges 26 between the second and third door sections are assigned location #2, hinges 28 between the third and fourth door sections are assigned location #3, and so on.

Referring now to prior art FIG. 1A, each hinge 30 generally includes first bracket 32 and second bracket 34, pivotally coupled by hinge pin 36. After the hinge for location #1, each successive hinge includes a bushing 38 for receiving an axle and a roller that rides in track 20. The bushing is located further and further away from the door to accommodate the vertical rearward slant of track 20. As can be seen from FIGS. 1 and 1A, hinge 24 (position #1) has the axle and roller riding in hinge pin 36. For hinge 26 (position #2), the axle and roller ride in bushing 38 which is slightly vertically offset from the axis of hinge pin 36. As can be seen, each successive hinge positions bushing 38 is further horizontally offset from hinge pin 36—in order to accommodate the slant of track 20 rearwardly away from frame 22 in the vertical direction.

It is typical for garage door manufacturers to supply different hinges for each of the numbered connections between different vertical panels of the door—so, it is necessary to manufacture and supply as many different hinges as there are different vertical garage door sections to be hinged. These different hinges are not interchangeable—for instance, a hinge at location #1 cannot be interchanged for a hinge at location #2, #3, #4, or any of the successive locations because the roller location would be incorrect and would cause binding when the door is opened and closed.

This leads to inefficiency in manufacturing in having to supply the different hinges, and to extra cost and delay when an installer or repair technician must ensure that a correctly numbered hinge is available and installed at each vertical door panel hinge point. What is needed in the industry is a universal overhead door hinge that can be easily adjusted to accommodate installation at any of the vertical locations on the door.

SUMMARY OF THE INVENTION

Embodiments of the invention meet the need in the industry for a universal overhead door hinge that can be easily adjusted to accommodate installation at any of the vertical locations on the door.

In an embodiment, a hinge for a multi-panel door includes a first bracket, a second bracket pivotally coupled to the first bracket, and a carrier link carrying a roller adapted to engage in a door track. The first bracket is adapted to be operably attached to a first panel of the multi-panel door, the second bracket is adapted to be operably attached to second panel of the multi-panel door, and the carrier link is pivotally attached to one of the first bracket or the second bracket. The carrier link is selectively positionable in a plurality of pre-defined positions, such that at each of the pre-defined positions, the roller is disposed at a different position relative to the first bracket and the second bracket. The carrier link can include a bushing, wherein the bushing receives an axle with the roller coupled to the axle.

The first bracket may have a planar central portion with a pair of upstanding spaced-apart flanges, the second bracket may have a planar central portion with a pair of upstanding spaced-apart flanges, and the first bracket may be pivotally coupled to the second bracket with a hinge pin extending through each of the upstanding flanges. The hinge may include a spring operably coupled to the carrier link and arranged to bias the carrier link relative to the first bracket or the second bracket. The upstanding flanges of the first bracket or the second bracket can define a plurality of notch pairs, each notch pair corresponding to a separate one of the pre-defined positions of the carrier link, wherein ends of the spring are receivable in each of said notch pairs to position the carrier link. In a further embodiment, the carrier link may be coupled to the first bracket or the second bracket with a selectively removable pin.

In a further embodiment, a door has a plurality of separate panels and a track, wherein each of the panels is pivotally coupled to at least one vertically adjacent panel with a separate hinge, and each hinge includes a first bracket, a second bracket pivotally coupled to the first bracket, and a carrier link carrying a roller engaged in the track. The first bracket is attached to a first one of the panels, the second bracket is attached to second one of the panels, and the carrier link is pivotally attached to one of the first bracket or the second bracket. The carrier link is selectively positionable in a plurality of pre-defined positions, such that at each of the pre-defined positions, the roller is spaced outwardly at a different distance relative to the door.

In an embodiment, each hinge may include a bushing, wherein the bushing receives an axle, and wherein the roller is coupled to the axle. The first bracket of each hinge may have a planar central portion with a pair of upstanding spaced-apart flanges, the second bracket of each hinge may have a planar central portion with a pair of upstanding spaced-apart flanges, with the first bracket pivotally coupled to the second bracket with a hinge pin extending through each of the upstanding flanges.

Each hinge further may include a spring operably coupled to the carrier link and arranged to bias the carrier link relative to the first bracket or the second bracket. The upstanding flanges of the first bracket or the second bracket may define a plurality of notch pairs, each notch pair corresponding to a separate one of the pre-defined positions of the carrier link, and wherein ends of the spring are receivable in each of said notch pairs to position the carrier link. The carrier link may be coupled to the first bracket or the second bracket with a selectively removable pin.

BRIEF DESCRIPTION OF THE DRAWINGS

The embodiments of the present invention may be more completely understood in consideration of the following detailed description of various embodiments in connection with the accompanying drawings, in which.

Figure 1:
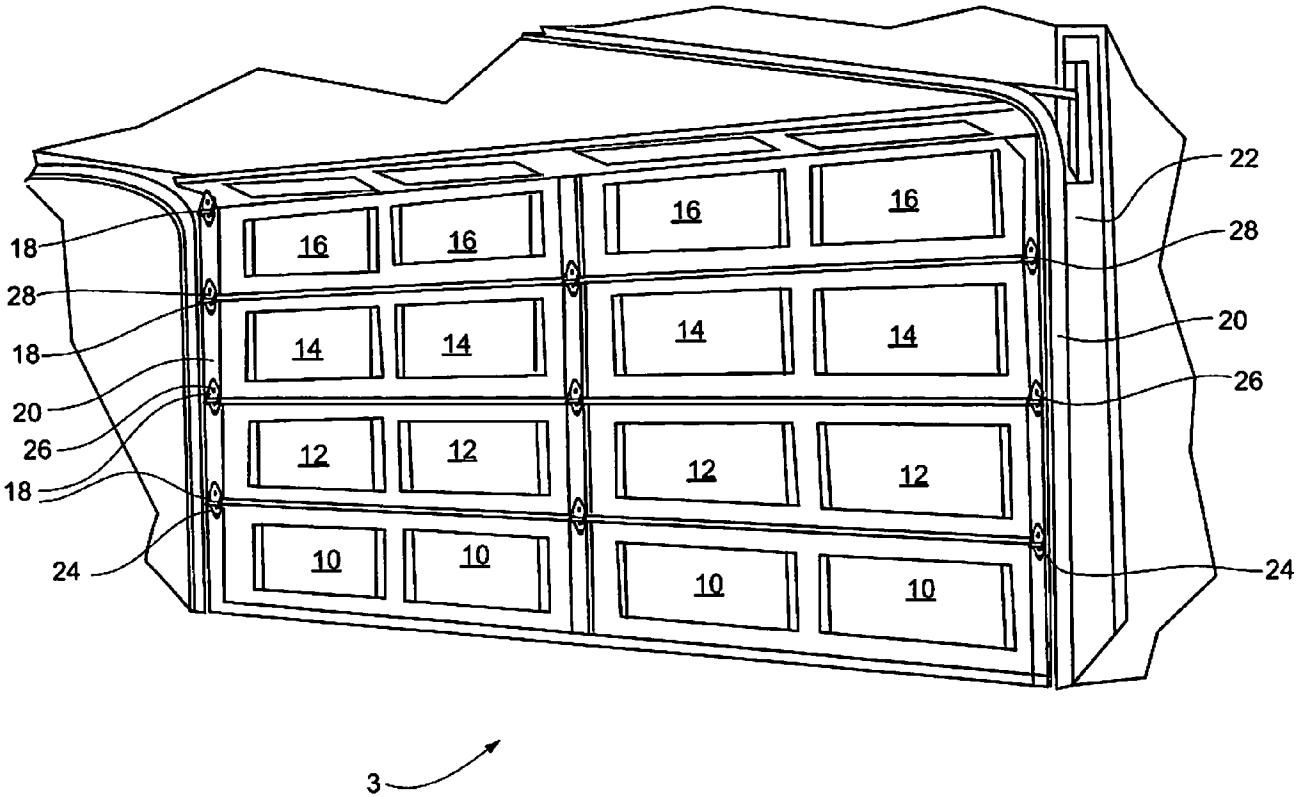
FIG. 1 is an isometric view of an overhead garage door.
Figure 1A:
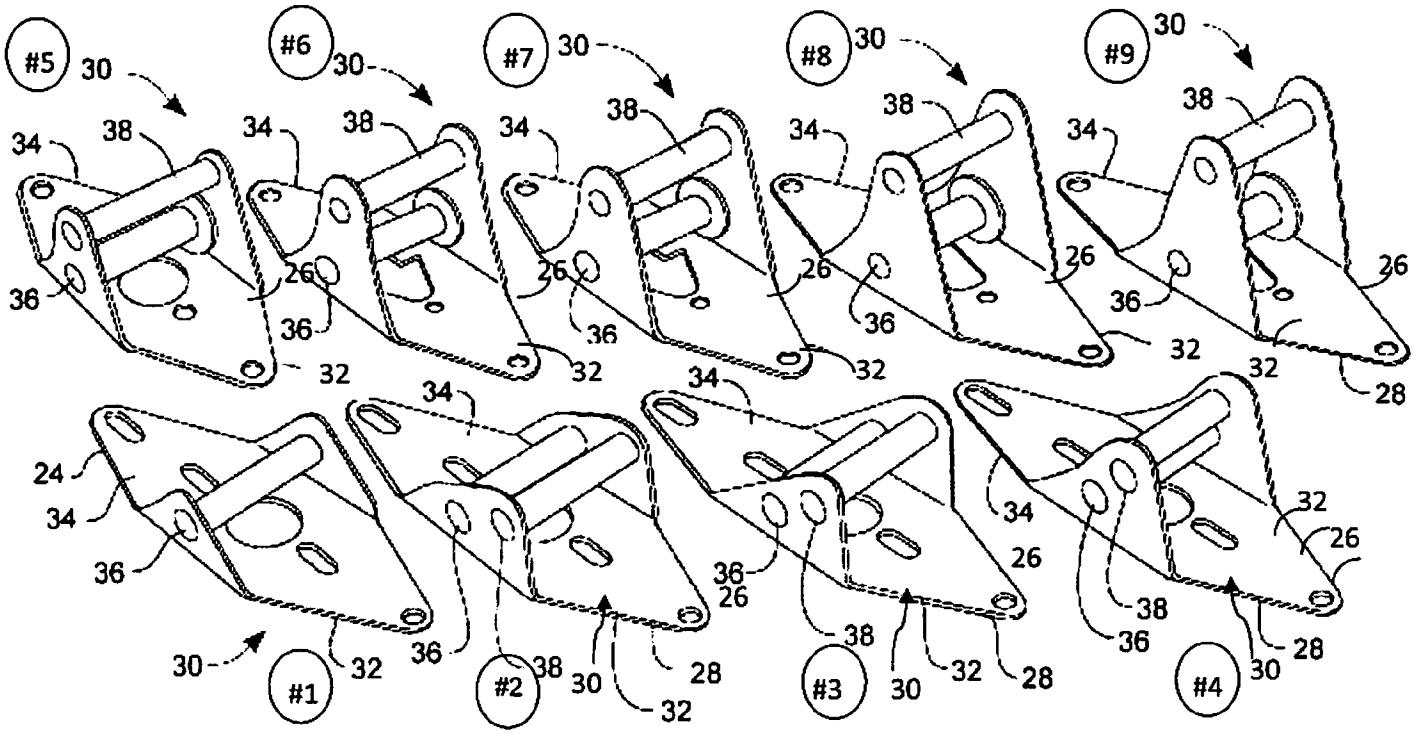
FIG. 1A is a perspective view of a plurality of prior art overhead garage door hinges, as numbered according to their vertical location on the door from bottom to top.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

An adjustable hinge 110 according to an embodiment of the invention is depicted in FIGS. 2-6. Adjustable hinge 110 generally includes first bracket 112, carrier link 114, and second bracket 116. First bracket 112 generally includes plate 118 and parallel flanges 120. Plate 118 defines elongate apertures 122 and flanges 120 each define pin-receiving apertures 124.

Second bracket 116 generally includes plate 126 and parallel flanges 128. Plate 126 defines elongate aperture 130, and aperture 132. Each flange 128 defines a pin-receiving aperture 134, notches 136*a*, 136*b*, and 136*c* in lower edge 138, and spring aperture 139.

Carrier link 114 generally includes center portion 140 and spaced-apart flanges 142. Center portion 140 has spring-receiving plate 144 oriented perpendicularly thereto. Each of flanges 142 defines a first aperture 146 and a second aperture 148.

Figure 2:
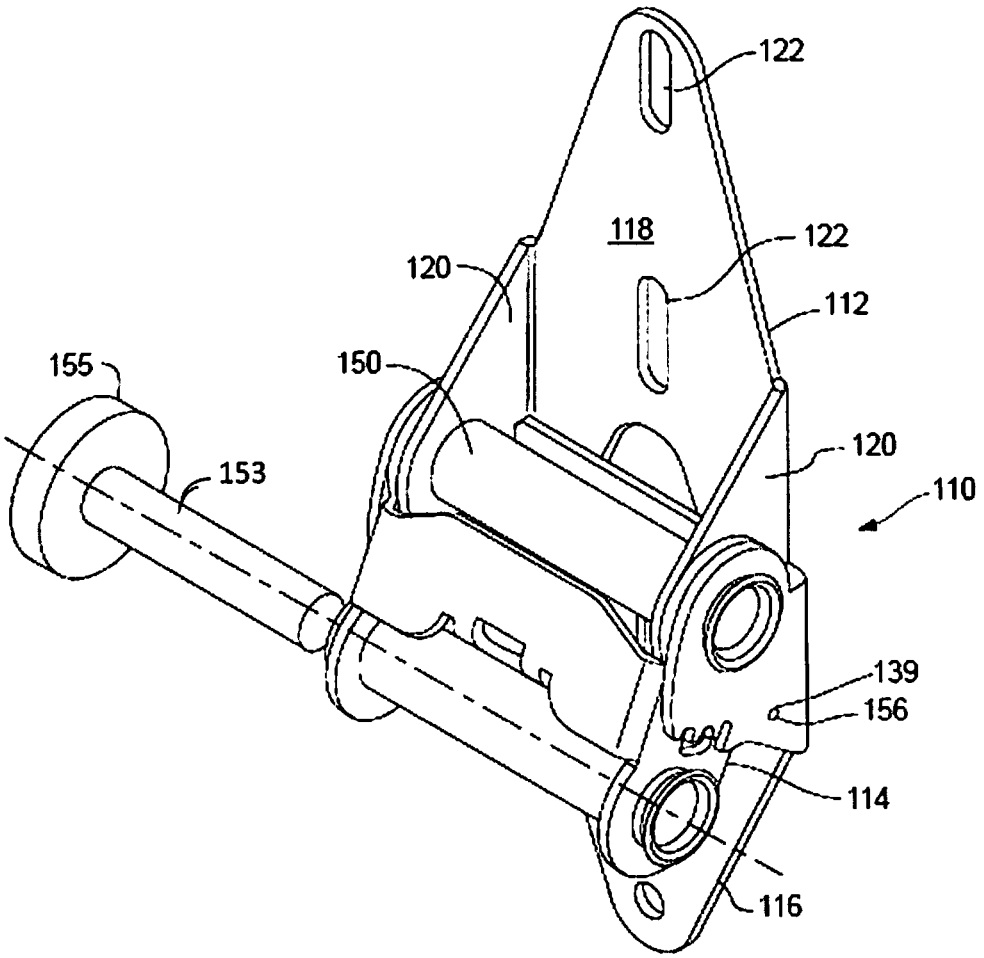
FIG. 2 is an isometric view of an adjustable hinge according to an embodiment of the invention.
Figure 3:
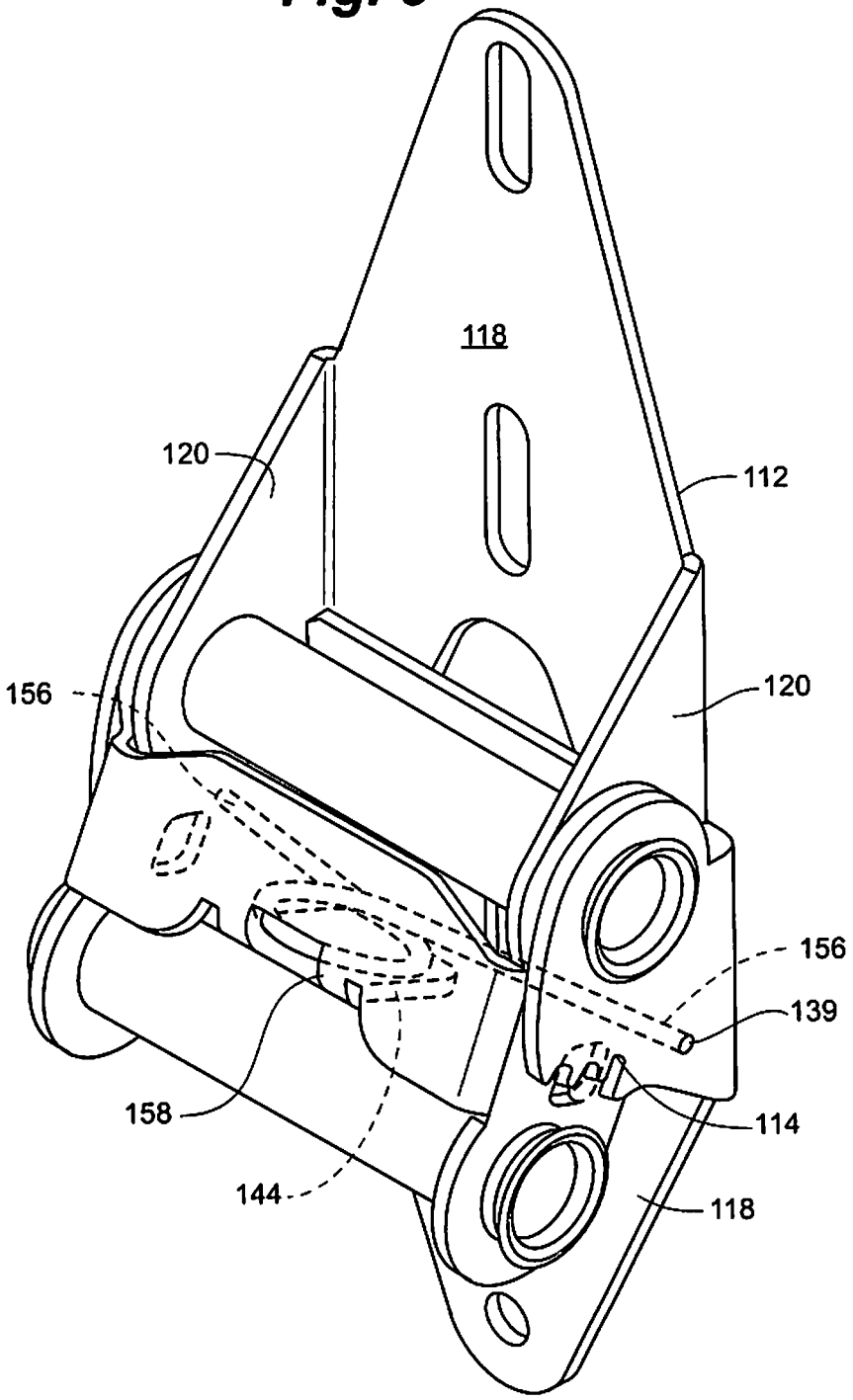
FIG. 3 is a front isometric view of the adjustable hinge of FIG. 2, with portions depicted in phantom so as to better illustrate the operation of the hinge.
Figure 3A:
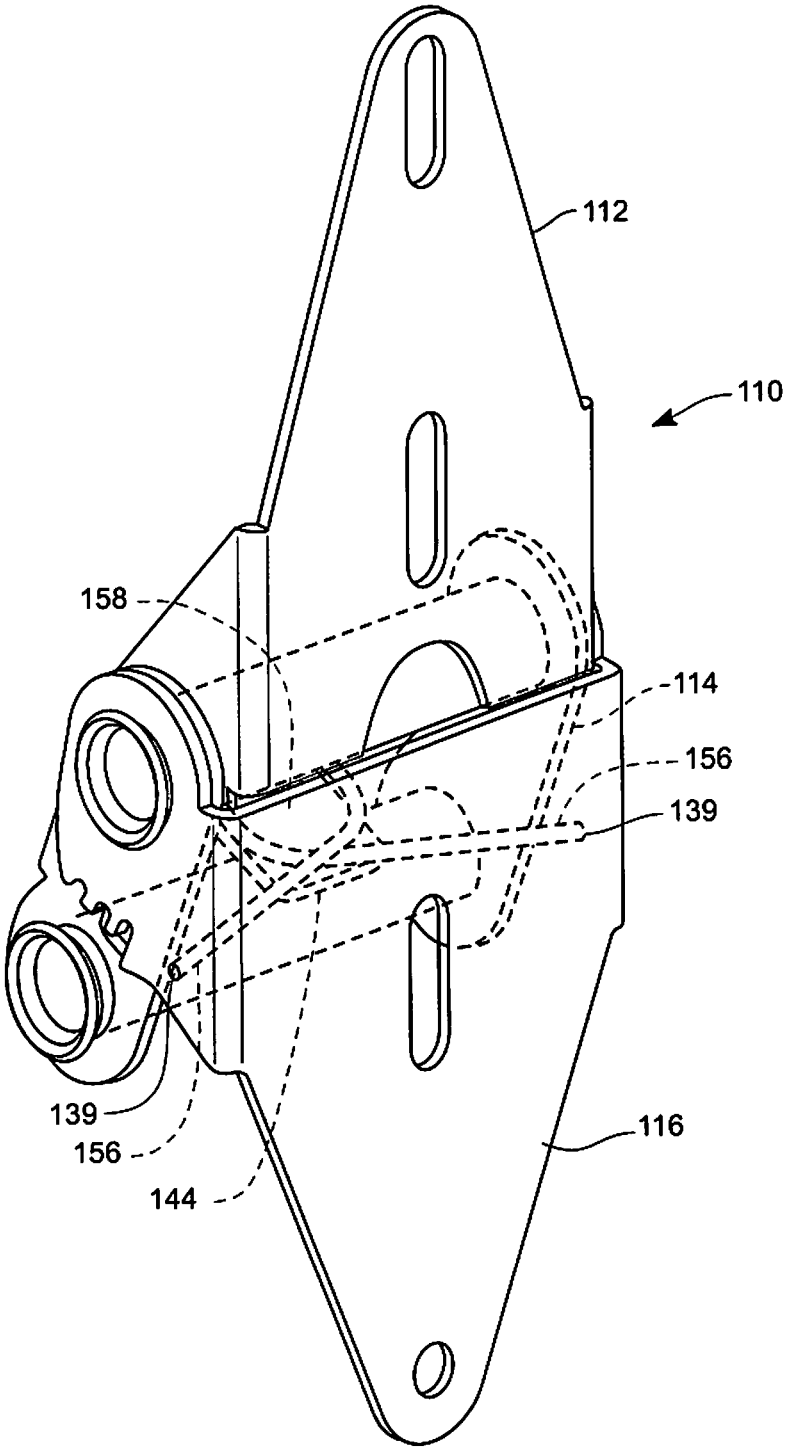
FIG. 3A is a rear isometric view of the adjustable hinge of FIG. 2, with portions depicted in phantom so as to better illustrate the operation of the hinge.
Figure 4:
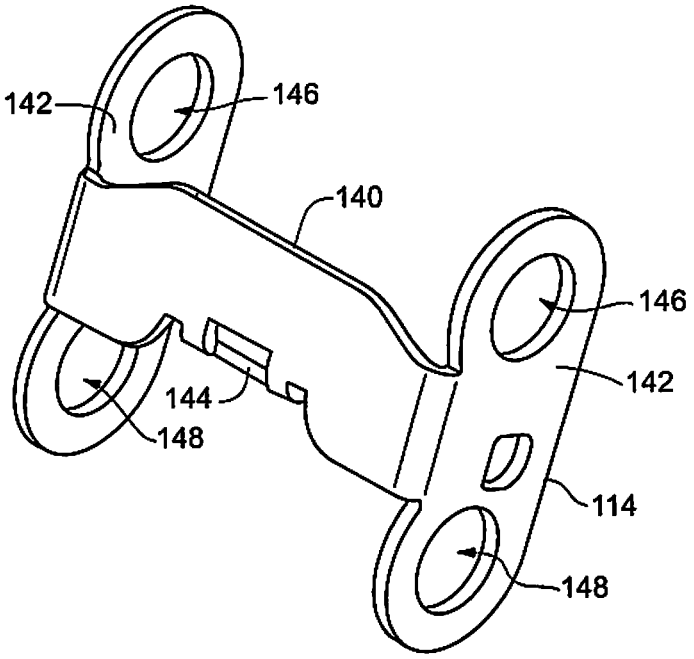
FIG. 4 is an isometric view of the carrier link of the hinge of FIG. 2.
Figure 5:
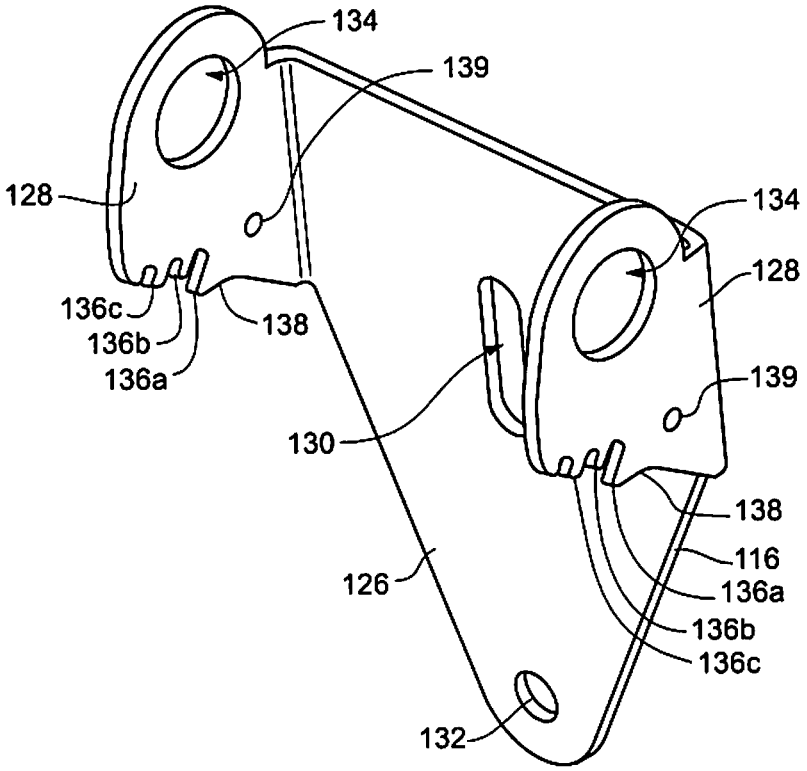
FIG. 5 is an isometric view of the lower bracket of the hinge of FIG. 2.
Figure 6:
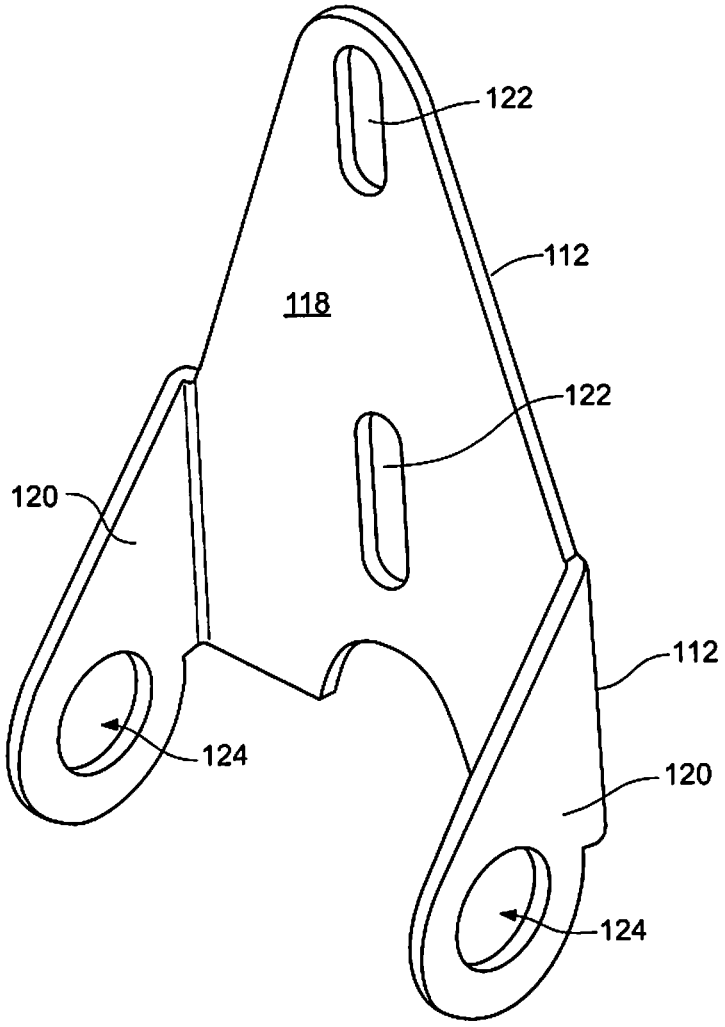
FIG. 6 is an isometric view of the upper bracket of the hinge of FIG. 2.

First bracket 112 is pivotally coupled to carrier link 114 and second bracket 116 with hinge pin 150 extending through apertures 124, 134, and 146. Bushing 152 is carried in apertures 148 of carrier link 114. Bushing 152 rotatably receives an axle 153 with a roller 155 that engages and rolls in track 120. As depicted in FIGS. 2 and 3, spring 154 is in a neutral position with ends 156 received in spring apertures 139, and with center portion 158 received on spring-receiving plate 144. With spring 154 in this neutral position, hinge 110 is suitable for installation as hinge 24 (location #1).

It will be appreciated that ends 156 of spring 154 can be shifted to any pair of notches 136*a*, 136*b*, and 136*c*, and by doing so, spring 154 will position carrier link 114 such that bushing 152, axle 153 and roller 155 will be spaced outwardly from the door 8 at different distances. For example, with ends 156 received in notches 136*a*, bushing 152 will be oriented such that hinge 110 can be installed as hinge 26 (location #2). With ends 156 received in notches 136*b*, bushing 152 will be oriented such that hinge 110 can be installed as hinge 28 (location #3), and so on.

As those of skill in the art will appreciate, hinge 110 can thus be used in any of the locations #1, #2, #3, and so on, assuming there are appropriately located notches 136*a*, 136*b*, 136*c*, and so on, and the ends 156 of spring 154 are positioned in the appropriate notches. In this way, the same hinge 110 can be supplied for all of the hinges in door 8, regardless of their relative vertical location, and hinge 110 can simply be adjusted by moving the ends 156 of spring 154 between notch pairs 136*a*, 136*b*, 136*c*, etc., to adjust the hinge for the vertical location on the door.

Those of skill in the art will also appreciate that spring 154 applies a bias to carrier link 114, such that, when closed, door 8 can be lightly spring loaded against the seal around frame 22, so as to better seal against weather and the entry of insects and other unwanted pests. The spring suspension provided by spring 154 can also make up for thermal expansion and contraction, and shift as necessary to account of settling of the garage and wear of the various components (door, frame, door trim, track, etc). Moreover, in that the hinge can flex to a changing environment through the action of spring 154, the need for service calls can be reduced relative to prior art doors and installation methods. In an embodiment of the invention, there may be about ⅜ inch of spring loaded travel when the hinge is installed in each of positions #1, #2, #3 or #4.

Figure 7:
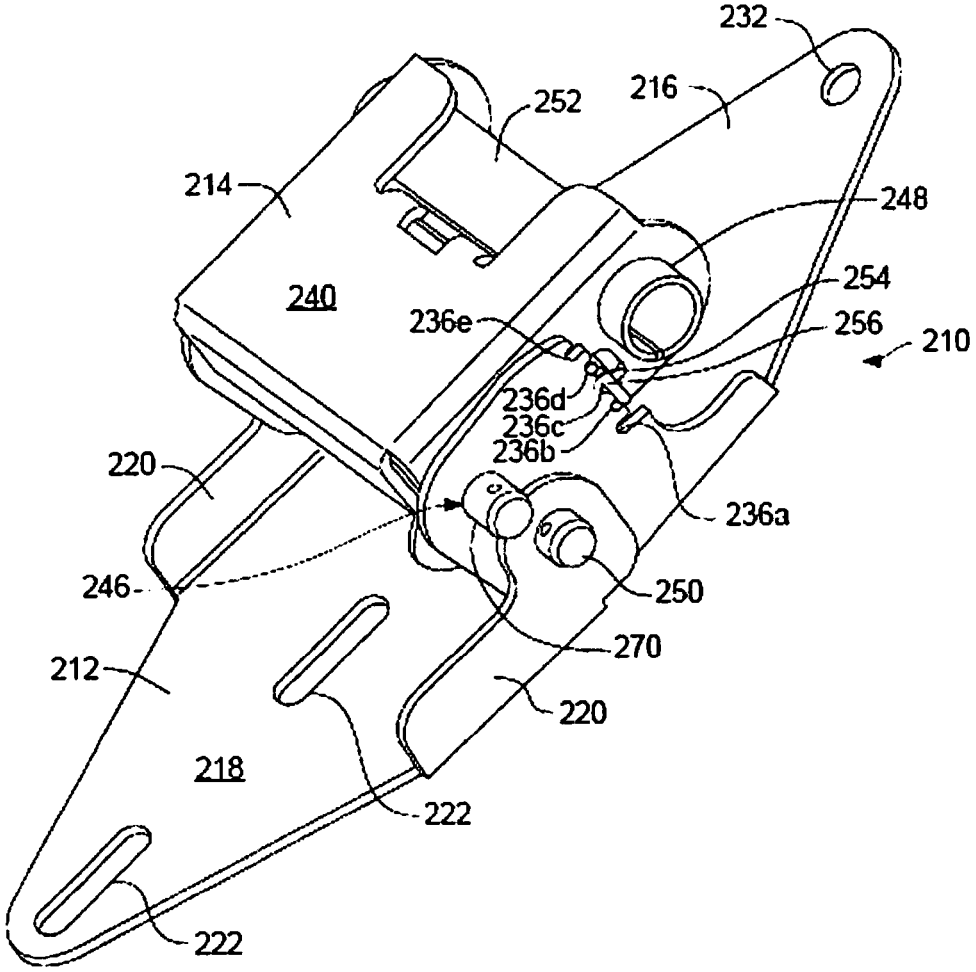
FIG. 7 is an isometric view of an alternative embodiment of an adjustable hinge according to the invention.
Figure 8:
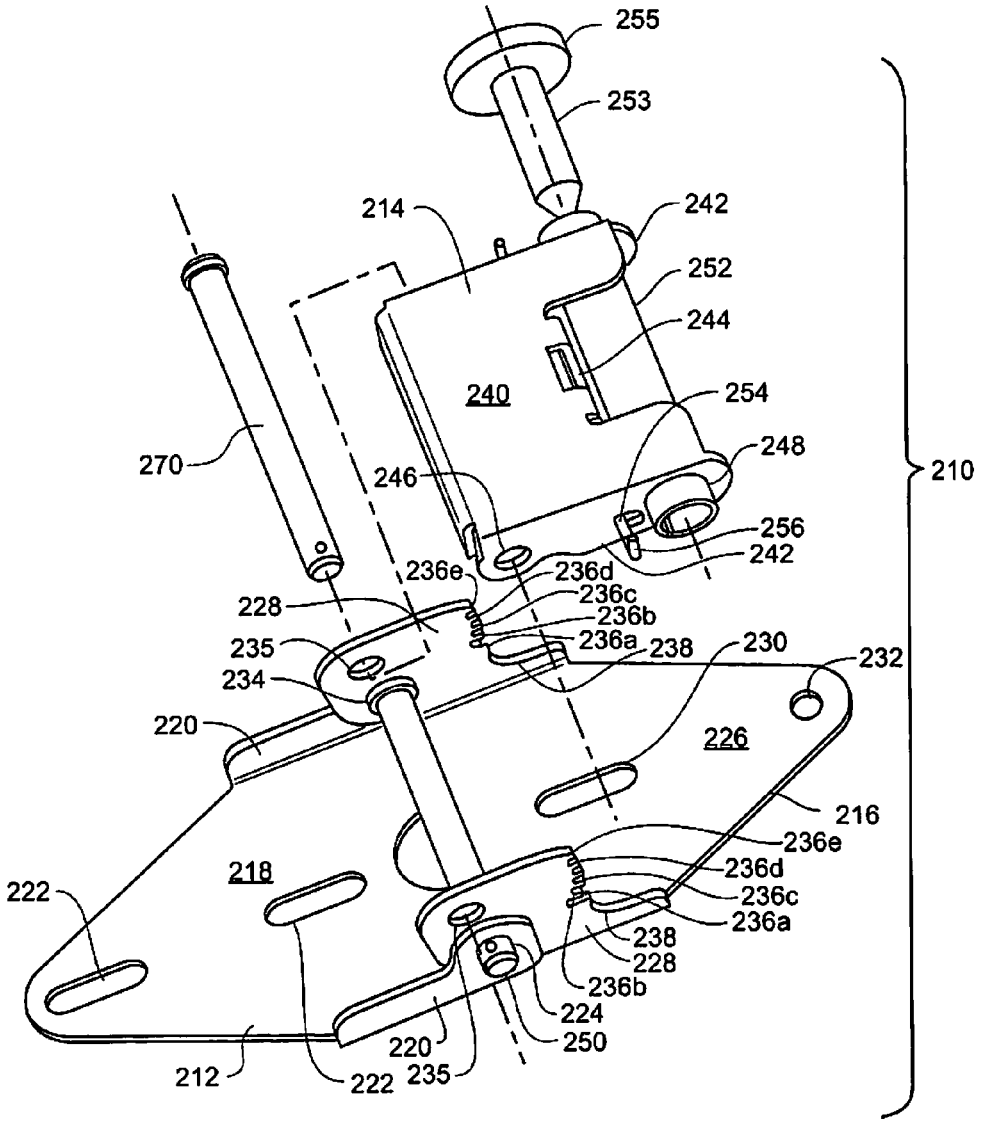
FIG. 8 is a partially exploded view of the hinge of FIG. 7.
Figure 9:
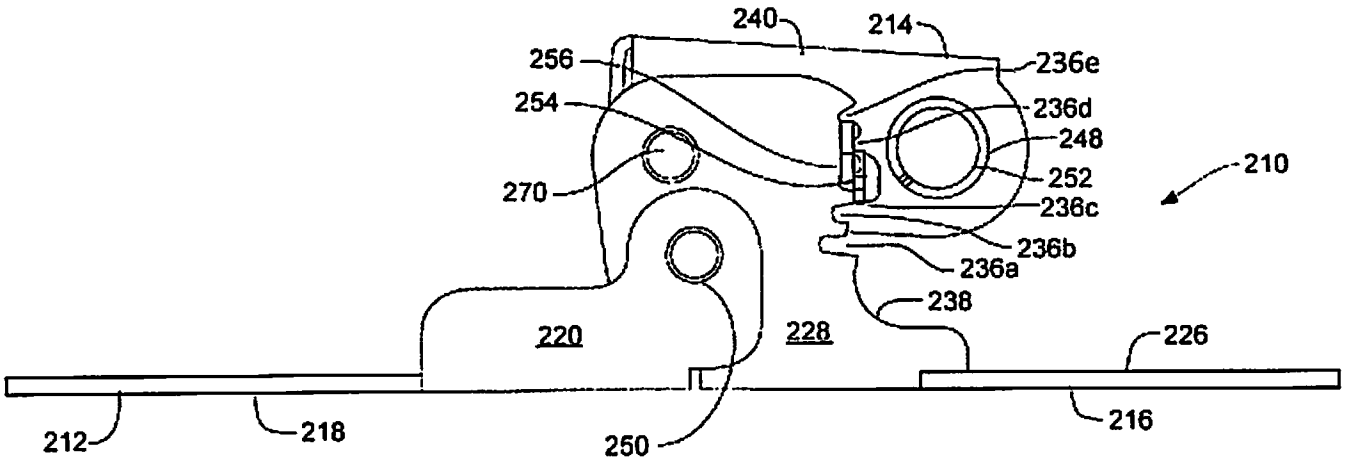
FIG. 9 is a side elevation view of the hinge of FIG. 7.

An adjustable hinge 210 according to an alternative embodiment of the invention is depicted in FIGS. 7-9. Adjustable hinge 210 generally includes first bracket 212, carrier link 214, and second bracket 216. First bracket 212 generally includes plate 218 and parallel flanges 220. Plate 218 defines elongate apertures 222 and flanges 220 each define pin-receiving apertures 224.

Second bracket 216 generally includes plate 226 and parallel flanges 228. Plate 226 defines elongate aperture 230, and aperture 232. Each flange 228 defines pin-receiving apertures 234, 235, and notches 236*a*, 236*b*, 236*c*, 236*d*, and 236*e* in lower edge 238.

Carrier link 214 generally includes center portion 240 and spaced-apart flanges 242. Center portion 240 has spring-receiving plate 244 oriented perpendicularly thereto. Each of flanges 242 defines a first aperture 246 and a second aperture 248.

First bracket 212 is pivotally coupled to second bracket 216 with hinge pin 250 extending through apertures 224, 234. Carrier link 214 is pivotally coupled to second bracket 216 with pin 270 extending through apertures 235, 246. Bushing 252 is carried in apertures 248 of carrier link 214. Again, bushing 252 rotatably receives an axle 253 with a roller 255 that engages and rolls in track 120. Just as for the first embodiment described above, it will be appreciated that ends 256 of spring 254 can be shifted to any pair of notches 236*a*, 236*b*, 236*c*, 236*d*, or 236*e*, and by doing so, spring 254 will position carrier link 214 such that bushing 252 (and the axle and roller riding therein) will be spaced outwardly from the door 8 at different distances. For example, with ends 256 received in notches 236*b*, bushing 252 will be oriented such that hinge 210 can be installed as hinge 26 (location #2). With ends 256 received in notches 236*c*, bushing 252 will be oriented such that hinge 210 can be installed as hinge 28 (location #3), and so on. It will be appreciated that pins 250 and 270 can be selectively removed and reinstalled as necessary to ease assembly of the hinge and door.

References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of 35 U.S.C. §112(f) are not to be invoked unless the specific terms "means for" or "step for" are recited in the subject claim.

What is claimed is:

1. A hinge for a multi-panel door, the hinge comprising:

a first bracket having a planar central portion with a pair of upstanding spaced-apart flanges;

a second bracket, the second bracket having a planar central portion with a pair of upstanding spaced-apart flanges, wherein the first bracket is pivotally coupled to the second bracket with a hinge pin extending through each of the upstanding flanges of the first bracket and of the second bracket; and a carrier link carrying a roller adapted to engage in a door track and a spring operably coupled to the carrier link and arranged to bias the carrier link relative to the first bracket or the second bracket, wherein the first bracket is adapted to be operably attached to a first panel of the multi-panel door, the second bracket is adapted to be operably attached to a second panel of the multi-panel door, and the carrier link is pivotally attached to one of the first bracket or the second bracket, the carrier link selectively positionable in a plurality of pre-defined positions, such that at each of the pre-defined positions, the roller is disposed at a different position relative to the first bracket and the second bracket, wherein the upstanding flanges of the first bracket or the second bracket define a plurality of notch pairs, each notch pair corresponding to a separate one of the pre-defined positions of the carrier link, and wherein ends of the spring are receivable in each of said notch pairs to position the carrier link.

2. The hinge of claim 1, wherein the carrier link includes a bushing, wherein the bushing receives an axle, and wherein the roller is coupled to the axle.

3. The hinge of claim 1, wherein the carrier link is coupled to the first bracket or the second bracket with a selectively removable pin.

4. A door having a plurality of separate panels and a track, wherein each of the panels is pivotally coupled to at least one vertically adjacent panel with a separate hinge, each hinge comprising:

a first bracket having a planar central portion with a pair of upstanding spaced-apart flanges;

a second bracket, the second bracket having a planar central portion with a pair of upstanding spaced-apart flanges, wherein the first bracket is pivotally coupled to the second bracket with a hinge pin extending through each of the upstanding flanges of the first bracket and of the second bracket; and a carrier link carrying a roller engaged in the track and a spring operably coupled to the carrier link and arranged to bias the carrier link relative to the first bracket or the second bracket, wherein the first bracket is attached to a first one of the panels, the second bracket is attached to a second one of the panels, and the carrier link is pivotally attached to one of the first bracket or the second bracket, the carrier link selectively positionable in a plurality of pre-defined positions, such that at each of the pre-defined positions, the roller is spaced outwardly at a different distance relative to the door, wherein the upstanding flanges of the first bracket or the second bracket define a plurality of notch pairs, each notch pair corresponding to a separate one of the pre-defined positions of the carrier link, and wherein ends of the spring are receivable in each of said notch pairs to position the carrier link.

5. The door of claim 4, wherein the carrier link includes a bushing, wherein the bushing receives an axle, and wherein the roller is coupled to the axle.

6. The door of claim 4, wherein the carrier link is coupled to the first bracket or the second bracket with a selectively removable pin.

* * * * *